US011747019B1

(12) United States Patent
Nath et al.

(10) Patent No.: US 11,747,019 B1
(45) Date of Patent: Sep. 5, 2023

(54) AERODYNAMIC COMBUSTOR LINER DESIGN FOR EMISSIONS REDUCTIONS

(71) Applicant: General Electric Company, Schenectady, NY (US)

(72) Inventors: Hiranya Nath, Bengaluru (IN); Ravindra Shankar Ganiger, Bengaluru (IN); Michael A. Benjamin, Cincinnati, OH (US); Steven C. Vise, Loveland, OH (US); Perumallu Vukanti, Bengaluru (IN); Sripathi Mohan, Bengaluru (IN); Rimple Rangrej, Bengaluru (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/929,359

(22) Filed: Sep. 2, 2022

(51) Int. Cl.

| | |
|---|---|
| ***F23R 3/06*** | (2006.01) |
| ***F23R 3/16*** | (2006.01) |
| ***F23R 3/50*** | (2006.01) |
| ***F23R 3/46*** | (2006.01) |

(52) U.S. Cl.
CPC ..... *F23R 3/06* (2013.01); *F23R 3/16* (2013.01); *F23R 3/46* (2013.01); *F23R 3/50* (2013.01); *F23R 2900/03043* (2013.01)

(58) Field of Classification Search
CPC .... F23R 3/002; F23R 3/04; F23R 3/06; F23R 3/16; F23R 3/50; F23R 2900/03041–03045
See application file for complete search history.

(56) References Cited

U.S. PATENT DOCUMENTS

| | | | | |
|---|---|---|---|---|
| 3,082,603 A * | 3/1963 | Hering | F23R 3/42 | 60/752 |
| 3,958,416 A | 5/1976 | Hammond, Jr. et al. | | |
| 4,170,110 A * | 10/1979 | Radin | F23R 3/28 | 60/768 |
| 4,413,477 A | 11/1983 | Dean et al. | | |
| 4,912,931 A * | 4/1990 | Joshi | F23M 5/00 | 60/753 |
| 5,025,622 A * | 6/1991 | Melconian | F23R 3/50 | 60/39.464 |
| 5,127,221 A * | 7/1992 | Beebe | F23R 3/34 | 60/754 |
| 5,285,631 A * | 2/1994 | Bechtel, II | F23R 3/42 | 60/776 |
| 5,319,935 A | 6/1994 | Toon et al. | | |
| 5,735,126 A * | 4/1998 | Schulte-Werning | F23R 3/26 | 431/350 |
| 6,513,334 B2 | 2/2003 | Varney | | |

(Continued)

*Primary Examiner* — Alain Chau
(74) *Attorney, Agent, or Firm* — Venable LLP; Edward A. Kmett; Michele V. Frank

(57) ABSTRACT

A combustor liner has an annular outer liner and an annular inner liner that define a combustion chamber therebetween, the combustion chamber having a dilution zone. The annular outer liner and the annular inner liner each has a converging-diverging section extending into the dilution zone of the combustion chamber that form a throat between them. Each of the converging-diverging sections includes at least one dilution opening defined through the respective converging-diverging section at the throat for providing a flow of an oxidizer through a respective liner to the dilution zone of the combustion chamber.

20 Claims, 10 Drawing Sheets

(56) References Cited

U.S. PATENT DOCUMENTS

| | | | | |
|---|---|---|---|---|
| 7,389,643 | B2 * | 6/2008 | Simons | F23R 3/005 60/737 |
| 7,707,836 | B1 * | 5/2010 | Barnes | F23R 3/002 60/757 |
| 7,788,928 | B2 * | 9/2010 | De Sousa | F23R 3/50 60/753 |
| 8,028,528 | B2 | 10/2011 | Burd et al. | |
| 8,671,692 | B2 * | 3/2014 | Burd | F23R 3/50 60/722 |
| 8,707,708 | B2 * | 4/2014 | Wagner | F23R 3/002 60/755 |
| 9,322,553 | B2 | 4/2016 | Parsania et al. | |
| 9,366,436 | B2 * | 6/2016 | Clemen | F23R 3/60 |
| 9,404,654 | B2 | 8/2016 | Cunha et al. | |
| 10,514,171 | B2 * | 12/2019 | Wagner | F23R 3/50 |
| 10,865,987 | B2 * | 12/2020 | Syed | F23R 3/346 |
| 2006/0168967 | A1 * | 8/2006 | Simons | F23R 3/005 60/752 |
| 2007/0084213 | A1 * | 4/2007 | Burd | F23R 3/50 60/776 |
| 2009/0019854 | A1 * | 1/2009 | Simons | F23R 3/286 60/737 |
| 2009/0053054 | A1 | 2/2009 | Grooms et al. | |
| 2011/0203286 | A1 * | 8/2011 | Wagner | F23R 3/50 60/752 |
| 2012/0017599 | A1 * | 1/2012 | Burd | F23R 3/50 60/752 |
| 2012/0047895 | A1 * | 3/2012 | Sridhar | F23R 3/005 60/722 |
| 2014/0033728 | A1 * | 2/2014 | Marmilic | F02C 7/141 60/722 |
| 2014/0190175 | A1 * | 7/2014 | Wagner | F23R 3/50 60/776 |
| 2015/0113994 | A1 * | 4/2015 | Hu | F23R 3/283 60/759 |
| 2015/0260403 | A1 * | 9/2015 | Clemen | F23R 3/06 60/752 |
| 2017/0009651 | A1 * | 1/2017 | Syed | F23R 3/20 |
| 2019/0017441 | A1 * | 1/2019 | Venkatesan | F23R 3/002 |
| 2020/0277868 | A1 * | 9/2020 | Hucker | F01D 9/023 |

* cited by examiner

AERODYNAMIC COMBUSTOR LINER DESIGN FOR EMISSIONS REDUCTIONS

TECHNICAL FIELD

The present disclosure relates to a combustor liner and dilution of combustion gases in a combustion chamber of a gas turbine engine.

BACKGROUND

In conventional gas turbine engines, it has been known to provide a flow of dilution air into a combustion chamber downstream of a primary combustion zone. Conventionally, an annular combustor may include both an inner liner and an outer liner forming a combustion chamber between them. The inner liner and the outer liner may include dilution holes through the liners that provide a flow of air from a passage surrounding the combustor liners into a dilution zone of the combustion chamber. Conventional combustors have been known to implement a combustor liner that is generally straight in the lengthwise direction from a dome assembly, nearest to a primary combustion zone at the upstream end of the combustor, through a dilution zone in the middle portion of the combustor, and then have a gradual convergence in a secondary combustion zone downstream of the dilution zone near a turbine section entrance.

BRIEF DESCRIPTION OF THE DRAWINGS

Features, advantages, and embodiments of the present disclosure will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Various features, advantages, and embodiments of the present disclosure are set forth or apparent from consideration of the following detailed description, drawings, and claims. Moreover, it is to be understood that the following detailed description is exemplary and intended to provide further explanation without limiting the scope of the disclosure as claimed.

In a combustion section of a turbine engine, air flows through an outer passage surrounding a combustor liner. The air generally flows from an upstream end of the combustor liner to a downstream end of the combustor liner. Some of the airflow in the outer passage is diverted through dilution holes in the combustor liner and into the combustion chamber as dilution air. One purpose of the dilution airflow is to cool (i.e., quench) combustion gases within the combustion chamber before the gases enter a turbine section. However, quenching of the product of combustion from the primary zone must be done quickly and efficiently so that regions of high temperature can be minimized, and thereby NOx emissions from the combustion system can be reduced.

The present disclosure aims to reduce the NOx emissions by improving the dilution quenching of the hot combustion gases from the primary combustion zone. According to the present disclosure, a combustor liner includes a converging-diverging portion in the dilution zone, with dilution airflow openings arranged in a throat section of the converging-diverging portion. The implementation of the converging-diverging portion in the combustor liners reduces the cross-sectional area of the combustor in the dilution zone, which results in a deeper penetration of the dilution airflow into the dilution zone so as to improve the quenching of the hot combustion gases, thereby reducing the NOx emissions.

Figure 1:
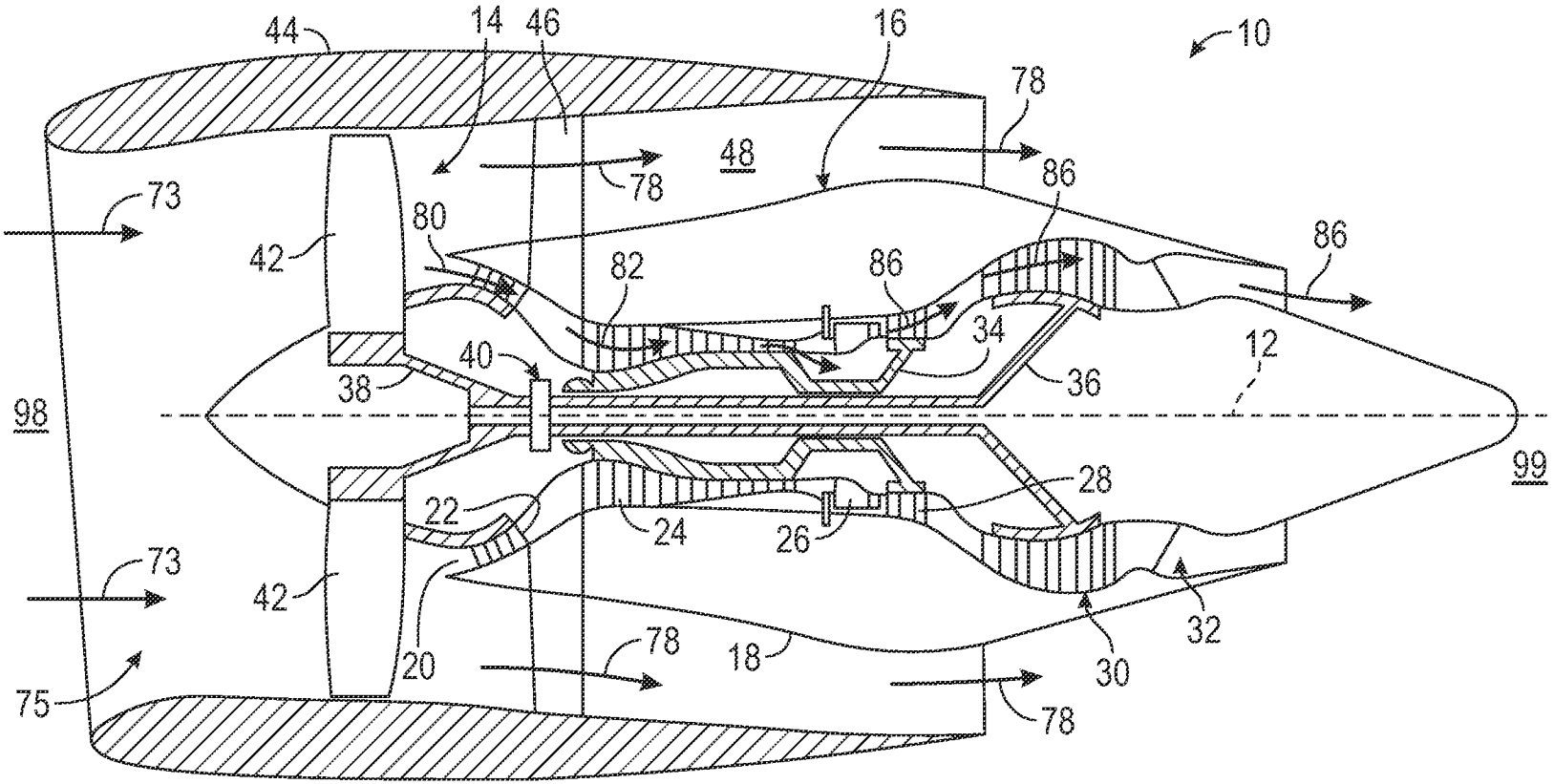
FIG. 1 is a schematic partially cross-sectional side view of an exemplary high by-pass turbofan jet engine, according to an embodiment of the present disclosure.

Referring now to the drawings, FIG. 1 is a schematic partially cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include an outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section, including a high pressure (HP) turbine 28, a low pressure (LP) turbine 30, and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive configuration or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and that extend radially outwardly from the fan shaft 38. An annular fan casing, or nacelle 44, circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16, so as to define a bypass airflow passage 48 therebetween.

Figure 2:
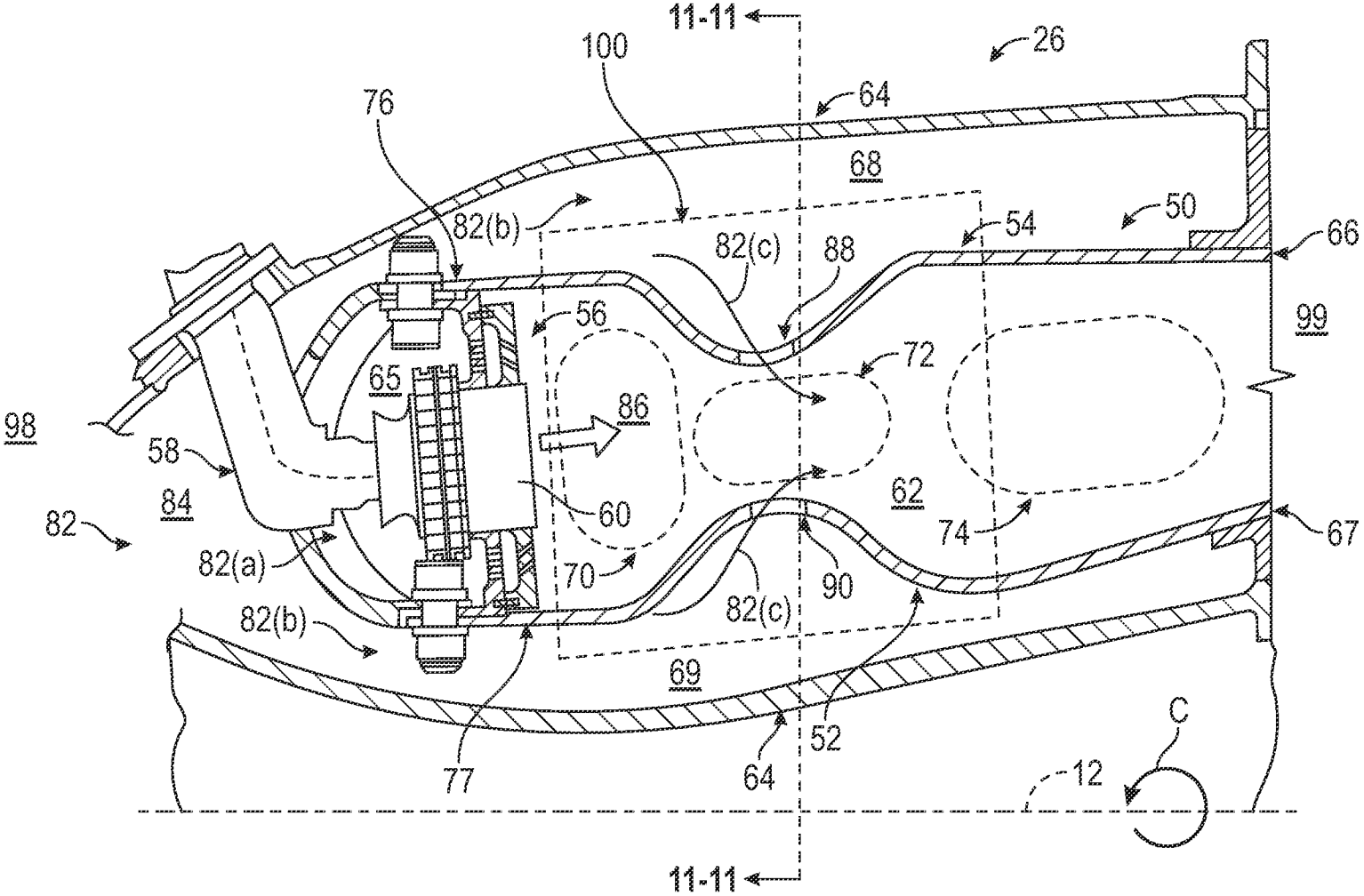
FIG. 2 is a cross-sectional side view of an exemplary combustion section, according to an embodiment of the present disclosure.

FIG. 2 is a cross-sectional side view of an exemplary combustion section 26 of the core engine 16 as shown in FIG. 1. As shown in FIG. 2, the combustion section 26 may generally include an annular type combustor assembly 50 having an annular inner liner 52, an annular outer liner 54, and a dome assembly 56, together defining a combustion chamber 62. The combustion chamber 62 may more specifically define various regions, including a primary combustion zone 70, at which initial chemical reaction of a fuel-oxidizer mixture and/or recirculation of combustion gases 86 may occur before flowing further downstream to a dilution zone 72, where mixture and/or recirculation of combustion products and air may occur before flowing to a secondary combustion zone 74, where the combustion products flow into HP and LP turbines 28, 30. The dome assembly 56 extends radially between an upstream end 76 of the annular outer liner 54 and an upstream end 77 of the annular inner liner 52.

As shown in FIG. 2, the annular inner liner 52 and the annular outer liner 54 may be encased within an outer casing 64. An outer flow passage 68 is defined between the outer casing 64 and the annular outer liner 54, and an inner flow passage 69 is defined between the outer casing 64 and the annular inner liner 52. The annular inner liner 52 may extend from the upstream end 77 at the dome assembly 56 to a downstream end 67 of the annular inner liner 52 at a turbine nozzle or inlet to the HP turbine 28 (FIG. 1). The annular outer liner 54 may extend from the upstream end 76 at the dome assembly 56 to a downstream end 66 of the annular outer liner 54 at the turbine nozzle. The annular outer liner 54 and the annular inner liner 52, therefore, at least partially define a hot gas path between the combustor assembly 50 and the HP turbine 28.

As further seen in FIG. 2, the annular inner liner 52 may include a plurality of dilution openings 90 and the annular outer liner 54 may include a plurality of dilution openings 88. As will be described in more detail below, the dilution openings 88 and the dilution openings 90 provide a flow of compressed air 82(*c*) therethrough and into the combustion chamber 62. The flow of compressed air 82(*c*) can thus be utilized to provide quenching of the combustion gases 86 in the dilution zone 72 downstream of the primary combustion zone 70 so as to cool the flow of combustion gases 86 entering the turbine section.

During operation of the engine 10, as shown in FIGS. 1 and 2 collectively, a volume of air 73, as indicated schematically by arrows, enters the engine 10 from the upstream end 98 through an associated inlet 75 of the nacelle 44 and/or fan assembly 14. As the volume of air 73 passes across the fan blades 42, a portion of the air, as indicated schematically by arrows 78, is directed or routed into the bypass airflow passage 48, while another portion of the air, as indicated schematically by an arrow 80, is directed or routed into the LP compressor 22. Air portion 80 is progressively compressed as it flows through the LP and HP compressors 22, 24 towards the combustion section 26. As shown in FIG. 2, the now compressed air, as indicated schematically by arrow 82, flows across a compressor exit guide vane (CEGV) (not shown) and through a pre-diffuser (not shown) into a diffuser cavity 84 of the combustion section 26.

The compressed air 82 pressurizes the diffuser cavity 84. A first portion of the compressed air 82, as indicated schematically by arrows 82(*a*), flows from the diffuser cavity 84 into pressure plenum 65, where it is then swirled by and mixed with fuel, provided by a fuel nozzle assembly 58, by a mixer assembly 60 to generate a swirled fuel-air mixture that is then ignited and burned to generate combustion gases 86 within the primary combustion zone 70 of the combustor assembly 50. Typically, the LP and HP compressors 22, 24 provide more compressed air to the diffuser cavity 84 than is needed for combustion. Therefore, a second portion of the compressed air 82, as indicated schematically by arrows 82(*b*), may be used for various purposes other than combustion. For example, as shown in FIG. 2, compressed air 82(*b*) may be routed into the outer flow passage 68 and into the inner flow passage 69. A portion of the compressed air 82(*b*) may then be routed through the dilution opening 88 (schematically shown as compressed air 82(*c*)) and into the dilution zone 72 of the combustion chamber 62 to provide quenching of the combustion gases 86 in the dilution zone 72, and may also provide turbulence to the flow of combustion gases 86 so as to provide better mixing of the dilution oxidizer gas (compressed air 82(*c*)) with the combustion gases 86. A similar flow of the compressed air 82(*c*) from the inner flow passage 69 through the dilution opening 90 occurs. In addition, or in the alternative, at least a portion of compressed air 82(*b*) may be routed out of the diffuser cavity 84. For example, a portion of compressed air 82(*b*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive at the downstream end 99.

As will be described in more detail below, the combustor 50 includes a combustor liner converging-diverging portion 100. The combustor liner converging-diverging portion 100 includes an outer liner converging/diverging section 102 (see FIG. 3) in the dilution zone 72 of the combustion chamber 62, and an inner liner converging/diverging section 104 (FIG. 3) in the dilution zone 72 of the combustion chamber 62. One purpose of the combustor liner converging/diverging portion 100 is to provide for better quenching of the combustion gases 86 deeper within the dilution zone 72 of the combustion chamber 62 so as to reduce NOx emissions. Various arrangements of the combustor liner converging-diverging portion 100, and various arrangements of dilution openings therethrough, will be described below with regard to FIGS. 3 to 10.

Figure 3:
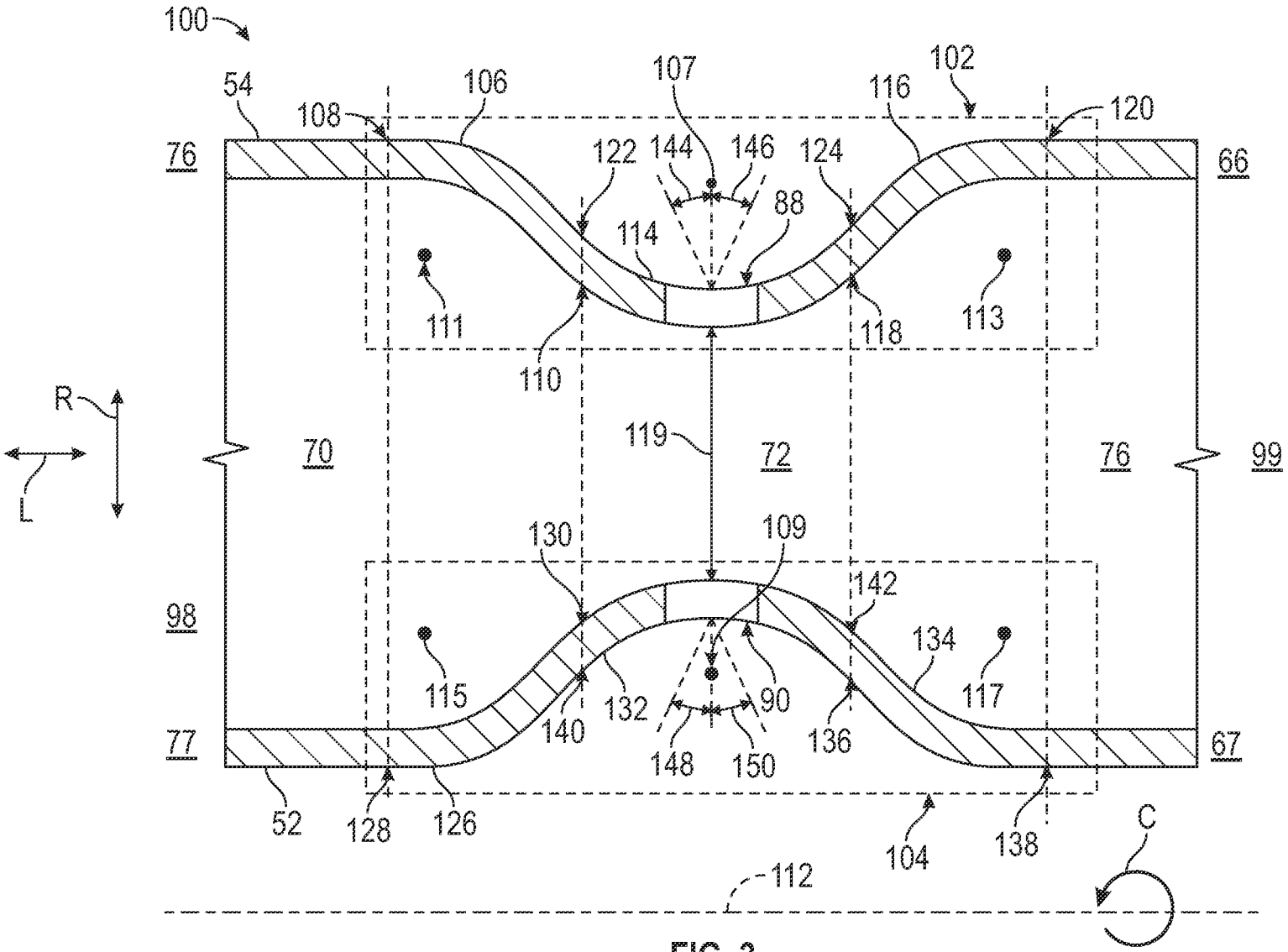
FIG. 3 depicts a partial cross-sectional side view of an exemplary converging-diverging portion of a combustor liner, according to an aspect of the present disclosure.

FIG. 3 is a partial cross-sectional side view of a combustor liner converging-diverging portion 100, according to an aspect of the present disclosure. The combustor liner diverging-converging portion 100 includes the outer liner converging-diverging section 102, and the inner liner converging-diverging section 104, each of which will be described in more detail below. Both the outer liner converging-diverging section 102 and the inner liner converging-diverging section 104 extend circumferentially about a combustor centerline 112 of the combustor, and also extend in the longitudinal direction L, with respect to the combustor centerline 112. Here, the combustor centerline 112 may be the same as the engine centerline 12. The dilution zone 72 is defined between the outer liner converging-diverging section 102 and the inner liner converging diverging section 104.

The outer liner converging-diverging section 102 (hereafter referred to as an "OLCD section) that extends radially inward, with respect to the combustor centerline 112, into the dilution zone 72 of the combustion chamber 62. Similarly, the annular inner liner 52 includes an inner liner converging-diverging section 104 (hereafter referred to as an "ILCD section) that extends radially outward, with respect to the combustor centerline 112, into the dilution zone 72 of the combustion chamber 62. The OLCD section 102 and the ILCD section 104 are generally radially opposed to one another across the combustion chamber 62.

The OLCD section 102 includes at least one dilution opening 88 defined through the OLCD section 102 for providing a flow of an oxidizer (i.e., the compressed air 82(*c*)) through the annular outer liner 54 to the dilution zone 72 of the combustion chamber 62. Similarly, the ILCD section 104 includes at least one dilution opening 90 defined through the ILCD section 104 for providing a flow of the oxidizer (i.e., the compressed air 82(*c*)) through the annular inner liner 52 to the dilution zone 72 of the combustion chamber 62. Various arrangements of the dilution openings will be discussed in more detail below.

Referring still to FIG. 3, the OLCD section 102 can generally be constructed of three general parts, namely, a converging portion, a diverging portion, and a transition portion. More specifically, the OLCD section 102 includes an OLCD section converging portion 106 that converges radially inward and longitudinally aft, with respect to the combustor centerline 112, into the combustion chamber 62 from an upstream end 108 of the OLCD section 102 to an upstream end 110 of an OLCD section transition portion 114. The OLCD section converging portion 106 may take the shape of a semi-circle with a center 111 thereof being located within the combustion chamber 62. Alternatively, the OLCD section converging portion 106 may have a parabolic shape or a straight line shape. The OLCD section 102 further includes an OLCD section diverging portion 116 that extends radially outward and longitudinally aft, with respect to the combustor centerline 112, from a downstream end 118 of the OLCD section transition portion 114 to a downstream end 120 of the OLCD section 102. The OLCD section diverging portion 116 may also have a semi-circular shape with a center 113 thereof being located within the combustion chamber 62. Alternatively, the OLCD section diverging portion 116 may have a parabolic shape or a straight line shape. The OLCD section transition portion 114 connects a downstream end 122 of the OLCD section converging portion 106 and an upstream end 124 of the OLCD section diverging portion 116. The OLCD section transition portion 114 may have a parabolic shape with a focus 107 thereof being located on a radially outward side of the OLCD section transition portion 114, with respect to the combustor centerline 112. The parabolic shape of the OLCD section transition portion 114 may have a width to depth ratio of 1:4. Alternatively, the OLCD section transition portion 114 may have a semi-circular shape or a straight line shape.

The ILCD section 104 is similar to, and more or less a mirror image of, the OLCD section 102. Thus, the ILCD section 104 includes an ILCD section converging portion 126 that converges radially outward and longitudinally aft, with respect to the combustor centerline 112, into the combustion chamber 62 from an upstream end 128 of the ILCD section 104 to an upstream end 130 of an ILCD section transition portion 132. The ILCD section converging portion 126 may have a semi-circular shape with a center 115 thereof being located within the combustion chamber 62. Alternatively, the ILCD section converging portion 126 may have a parabolic shape or a straight line shape. The ILCD section includes an ILCD section diverging portion 134 that extends radially inward and longitudinally aft, with respect to the combustor centerline 112, from a downstream end 136 of the ILCD section transition portion 132 to a downstream end 138 of the ILCD section 104. The ILCD section diverging portion 134 may have a semi-circular shape with a center 117 thereof being located within the combustion chamber 62. Alternatively, the ILCD section diverging portion 134 may have a parabolic shape or a straight line shape. The ILCD section transition portion 132 connects a downstream end 140 of the ILCD section converging portion 126 and an upstream end 142 of the ILCD section diverging portion 134. The ILCD section transition portion 132 may have a parabolic shape with a focus 109 thereof being located on a radially inward side of the ILCD section transition portion 132, with respect to the combustor centerline 112. The parabolic shape of the ILCD section transition portion 132 may have a width to depth ratio of 1:4. Alternatively, the ILCD section transition portion 132 may have a semi-circular shape or a straight line shape.

As can be seen in FIGS. 2 and 3, both the OLCD section 102 and the ILCD section 104 have a generally smooth transitioned sine wave type shape to provide for an aerodynamic flow of the compressed air 82(*b*) along the outer surface facing the outer flow passages 68, 69, and an aerodynamic flow of the combustion gases 86 within the combustion chamber 62. However, either or both of the OLCD section 102 and the ILCD section 104 may be formed with a trapezoidal-type structure having straight line segments instead of having a smooth curved sine wave type shape. The OLCD section transition portion 114 and the ILCD section transition portion 132 form a throat 119 between them, and as will be described in more detail below, various forms of dilution openings are provided through the transition portions so as to provide a dilution airflow in the throat 119.

Referring still to FIG. 3, the dilution openings 88 of the annular outer liner 54 and the dilution openings 90 of the annular inner liner 52 will now be described. In FIG. 3, the dilution opening 88 is shown to be defined through the OLCD section transition portion 114, and the dilution opening 90 is shown to be defined through the ILCD section transition portion 132. However, as will be described in more detail below, dilution openings through other portions of the OLCD section 102 and the ILCD section 104 may be implemented instead. In addition, the cross-sectional view of FIG. 3 depicts a single dilution opening 88 through the OLCD section transition portion 114, but it can readily be understood that a plurality of the dilution openings 88 may be included. For example, multiple dilution openings 88 may be circumferentially spaced around the annular outer liner 54. Similarly, multiple dilution openings 90 may be circumferentially spaced around the annular inner liner 52. In addition, while the dilution opening 88 and the dilution opening 90 are shown to be directly opposed to one another across the combustion chamber 62, they could be circumferentially or longitudinally offset from one another.

In FIG. 3, the dilution opening 88 and the dilution opening 90 are generally shown as being a circular hole or a cylindrical hole that is generally perpendicular to the combustor centerline 112. Other shapes such as square, elliptic, race-track, triangular, etc., however, may be implemented for the dilution opening 88 and the dilution opening 90. Further, while the dilution opening 88 and the dilution opening 90 are shown to be arranged generally perpendicular to the combustor centerline 112, they may be angled instead. For example, the dilution opening 88 may be arranged at a radial angle 144 or a radial angle 146, where the radial angle 144 may range from zero to minus thirty degrees and the radial angle 146 may range from zero to plus thirty degrees. Similarly, the dilution opening 90 may be angled at a radial angle 148 or at a radial angle 150, where the radial angle 148 may range from zero to plus thirty degrees and the radial angle 150 may range from zero to minus thirty degrees. Of course, the foregoing ranges are merely exemplary and other angle ranges may be implemented instead to obtain a desired dilution flow of the air through the dilution opening.

Figure 4:
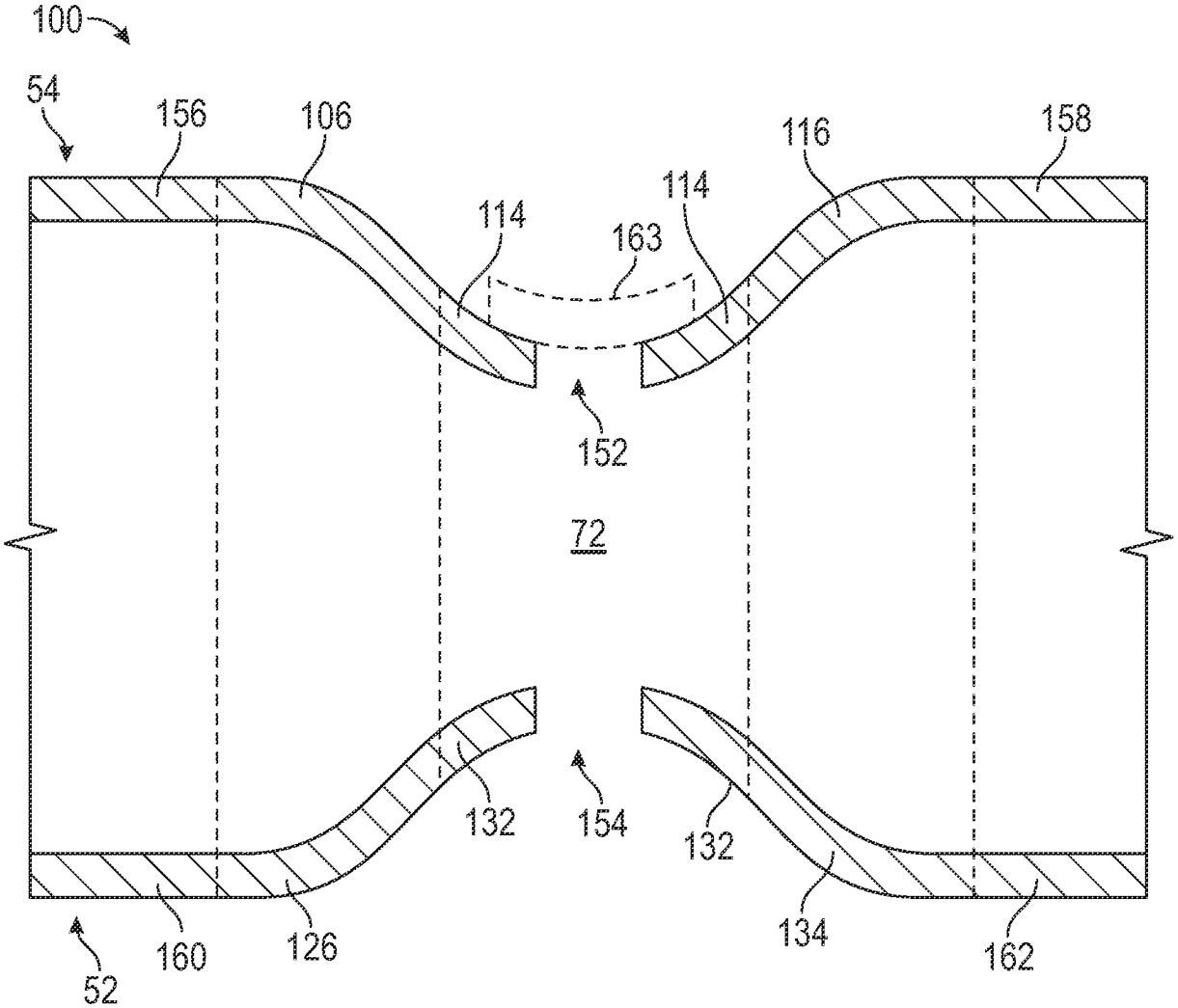
FIG. 4 depicts a partial cross-sectional side view of an exemplary converging-diverging portion of a combustor liner, according to another aspect of the present disclosure.

FIG. 4 is a partial cross-sectional side view of an exemplary combustor liner converging-diverging section 100, according to another aspect of the present disclosure. The aspect of FIG. 4 is similar to the aspect of FIG. 3 in all respects, except for the dilution openings. Therefore, like reference numerals between FIGS. 3 and 4 will not be discussed further for this aspect. Recall that, in the FIG. 3 aspect, the dilution openings constituted dilution holes through the transition portion of the annular outer liner 54 and the annular inner liner 52. In contrast, the FIG. 4 aspect implements an annular slot dilution opening 152 through the annular outer liner 54, and an annular slot dilution opening 154 through the annular inner liner 52. The annular slot dilution opening 152 extends circumferentially about the annular outer liner 54, and the annular slot dilution opening 154 extends circumferentially about the annular inner liner 52. Due to the implementation of the annular slot as the dilution opening, the FIG. 4 aspect includes dual liners. That is, the annular outer liner 54 is comprised of an outer liner forward section 156 and an outer liner aft section 158. Of course, the outer liner forward section 156 and the outer liner aft section 158 are joined by a plurality of connecting members 163. For example, each of the plurality of connecting members 163 may be a beam (or bridge) that is brazed, welded, or bolted to the outer liner forward section 156 and the outer liner aft section 158. The connecting members 163 may be circumferentially spaced about the annular outer liner 54. Similarly, the annular slot dilution opening 154 extends circumferentially about the annular inner liner 52. Connecting members (not shown) are also implemented to join an inner liner forward section 160 with an inner liner aft section 162. In FIG. 4, the annular slot dilution opening 152 and the annular slot dilution opening 154 are shown as being directly opposed to one another across the combustion chamber 62. However, they may be offset from one another in the longitudinal direction instead.

Figure 5:
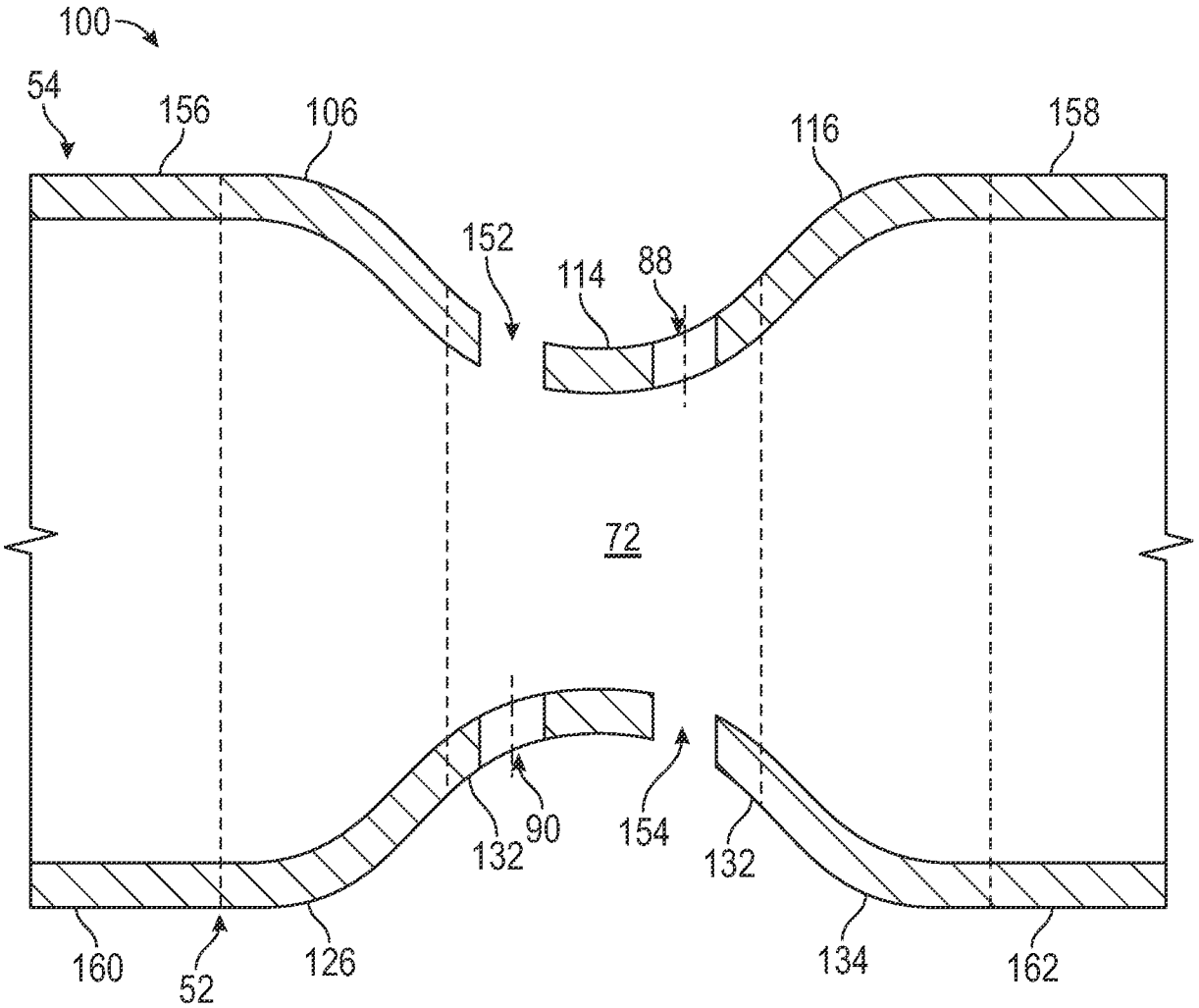
FIG. 5 depicts a partial cross-sectional side view of an exemplary converging-diverging portion of a combustor liner, according to still another aspect of the present disclosure.

FIG. 5 is a partial cross-sectional side view of a combustor liner converging-diverging section 100, according to yet another aspect of the present disclosure. The FIG. 5 aspect of the converging-diverging section implements aspects of both the FIG. 3 dilution openings and the FIG. 4 dilution openings. As seen in FIG. 5, the annular outer liner 54 includes both the annular slot dilution opening 152 and the circular hole-type dilution opening 88. Similarly, the annular inner liner 52 includes both the annular slot dilution opening 154 and the circular hole-type dilution opening 90. In the aspect shown in FIG. 5, the annular slot dilution opening 152 is shown to be opposed across the dilution zone 72 of the combustion chamber 62 by the dilution opening 90. Similarly, the annular slot dilution opening 154 is shown as being opposed across the dilution zone 72 of the combustion chamber 62 by the dilution opening 88. Of course, the present disclosure is not limited to the foregoing arrangement, and other arrangements could be implemented instead. For example, the annular slot dilution opening 152 and the annular slot dilution opening 154 could be opposed to one another similar to that shown in FIG. 4, while the dilution openings 88 and 90 could be opposed to one another as shown in FIG. 3.

Figure 6:
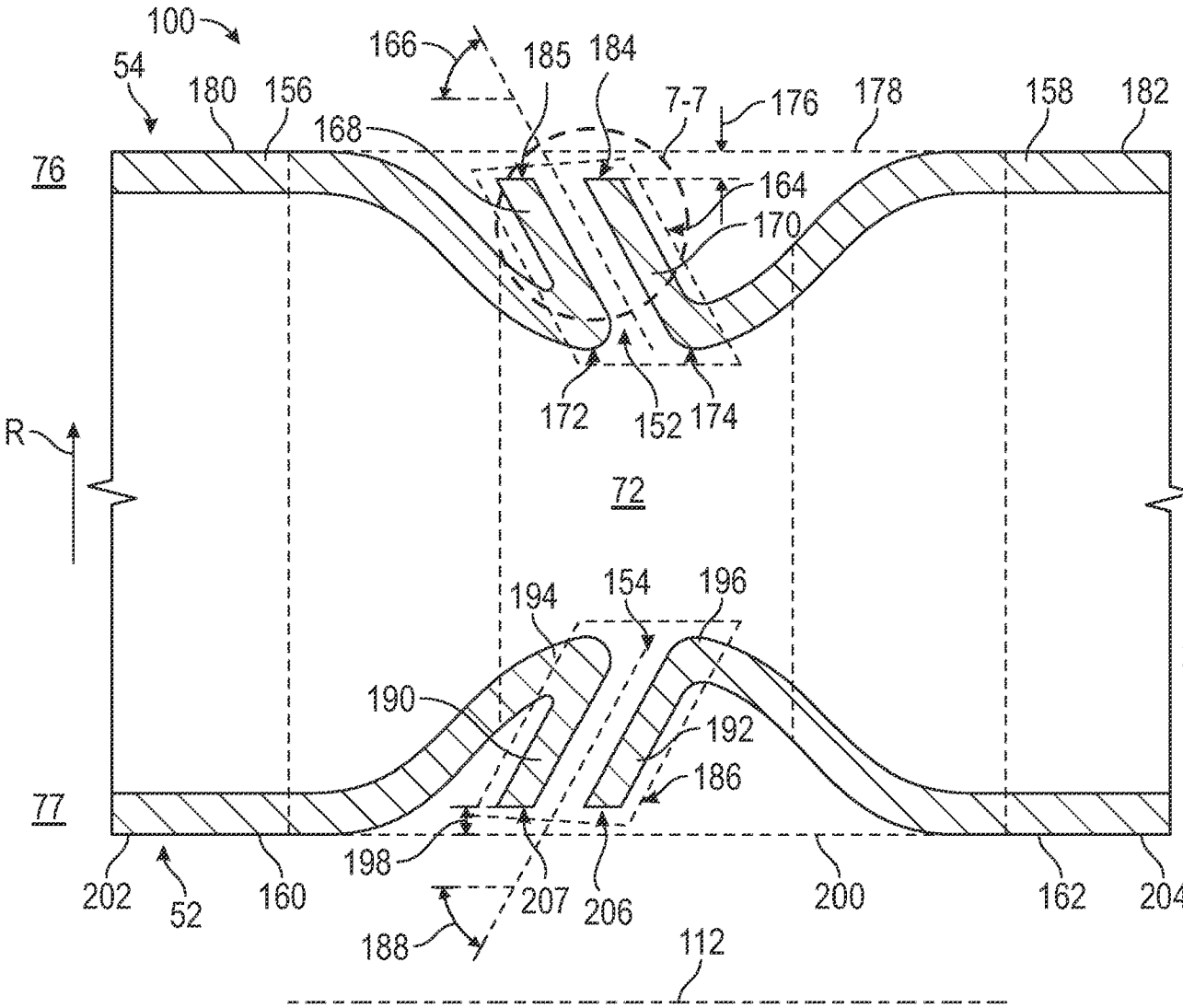
FIG. 6 depicts a partial cross-sectional side view of an exemplary converging-diverging portion of a combustor liner, according to an yet another aspect of the present disclosure.

FIG. 6 is a partial cross-sectional side view of a combustor liner converging-diverging section 100, according to still yet another aspect of the present disclosure. The aspect FIG. 6 is similar to the aspect of FIG. 4 in that it includes the annular slot dilution opening 152 as the dilution opening through annular outer liner 54 and the annular slot dilution opening 154 as the dilution opening through the annular inner liner 52. In FIG. 6, the annular slot dilution opening 152 of the annular outer liner 54 includes an outer liner dilution flow extension member 164 extending radially outward with respect to the combustor centerline 112 from the annular outer liner 54. As also shown in FIG. 6, the outer liner dilution flow extension member 164 may also extend upstream (i.e., toward the upstream end 76 of the annular outer liner 54) at a first angle 166 relative to the combustor centerline 112. In exemplary aspects, the first angle 166 may range from minus forty-five degrees (minus being in the upstream direction) to zero degrees, where zero degrees is generally perpendicular to the combustor centerline 112. In another aspect, the first angle 166 may range from zero degrees to plus forty-five degrees (plus being in the downstream direction toward the downstream end 66 of the annular outer liner 54). Of course, the range of the first angle 166 is not limited to the foregoing and other ranges may be implemented instead. One objective of the first angle 166 for the outer liner dilution flow extension member 164 is to provide a directional flow of the dilution air into the dilution zone 72 of the combustion chamber 62.

As was discussed above with regard to FIG. 4, the implementation of the annular slot dilution opening 152 in the annular outer liner 54 results in a dual liner that includes an outer liner forward section 156 and an outer liner aft section 158. The same applies to the aspect disclosed herein with regard to FIG. 6. Thus, with respect to the outer liner dilution flow extension member 164, the outer liner forward section 156 includes an outer liner dilution flow extension member forward portion 168, and the outer liner aft section 158 includes an outer liner dilution flow extension member aft portion 170. The outer liner dilution flow extension member forward portion 168 may be formed via an outer liner forward section bend 172 in the liner material, or may be a separate member that is brazed or welded in place. Similarly, the outer liner dilution flow extension member aft portion 170 may be formed via an outer liner aft section bend 174 in the liner material, or may be a separate element that is brazed or welded to the outer liner material.

A radial length (i.e., a height) of the outer liner dilution flow extension member 164 may be taken with respect to an outer liner outer surface 178, shown as an imaginary line connecting an outer liner forward section outer surface 180 and an outer liner aft section outer surface 182. The radial length is taken as a distance 176 from the outer liner outer surface 178 to a radially outer surface 184 of the outer liner dilution flow extension member aft portion 170, and from the outer liner outer surface 178 to a radially outer surface 185 of the outer liner dilution flow extension member forward portion 168. As seen in FIG. 6, the radially outer surface 184 of the outer liner dilution flow extension member aft portion 170 may be arranged at a distance 176 from the outer liner outer surface 178 that, as shown in FIG. 6, may be below (i.e., radially inward of) the outer liner outer surface 178. Alternatively, the radially outer surface 184 may be even with the outer liner outer surface 178 such that the distance 176 is zero, or the radially outer surface 184 may extend radially outward of the outer liner outer surface 178, such that the distance 176 extends above the outer liner outer surface 178. The same distance 176 applies to the radially outer surface 185 of the outer liner dilution flow extension member forward portion 168. Additionally, while the radially outer surface 185 of the outer liner dilution flow extension member forward portion 168 and the radially outer surface 184 of the outer liner dilution flow extension member aft portion 170 are shown in FIG. 6 as being arranged at the same distance 176 from the outer liner outer surface 178, they may have different lengths instead. For example, the distance 176 to the radially outer surface 185 of the outer liner dilution flow extension member forward portion 168 may be as shown in FIG. 6 (i.e., below the outer liner outer surface 178), while the distance 176 to the radially outer surface 184 of the outer liner dilution flow extension member aft portion 170 may be such that it is even with the outer liner outer surface 178, or extended radially outward beyond the outer liner outer surface 178. When this arrangement is implemented, the longer length outer liner dilution flow extension member aft portion 170 may provide for deflecting more of the air into the outer liner dilution flow extension member 164.

The aspect of FIG. 6 also includes the annular slot dilution opening 154 as the dilution opening through annular inner liner 52. The annular slot dilution opening 154 of the annular inner liner 52 includes an inner liner dilution flow extension member 186, which may be a mirror image of the outer liner dilution flow extension member 164. Thus, the inner liner dilution flow extension member 186 extends radially inward with respect to the combustor centerline 112 from the annular inner liner 52. As also shown in FIG. 6, the inner liner dilution flow extension member 186 may also extend upstream (i.e., toward the upstream end 77 of the annular inner liner 52) at a second angle 188 relative to the combustor centerline 112. In exemplary aspects, the second angle 188 may range from minus forty-five degrees (minus being in the upstream direction) to zero degrees, where zero degrees is generally perpendicular to the combustor centerline 112. In another aspect, the second angle 188 may range from zero degrees to plus forty-five degrees (plus being in the downstream direction toward downstream end 67 of the annular inner liner 52). Of course, the range of the second angle 188 is not limited to the foregoing and other ranges may be implemented instead. One objective of the second angle 188, like the first angle 166, for the inner liner dilution flow extension member 186 is to provide a directional flow of the dilution air into the dilution zone 72 of the combustion chamber 62.

Again, as was discussed above, the implementation of the annular slot dilution opening 154 in the annular inner liner 52 results in a dual liner that includes an inner liner forward section 160 and an inner liner aft section 162. Thus, with respect to the inner liner dilution flow extension member 186, the inner liner forward section 160 includes an inner liner dilution flow extension member forward portion 190, and the inner liner aft section 162 includes an inner liner dilution flow extension member aft portion 192. The inner liner dilution flow extension member forward portion 190 may be formed via an inner liner forward section bend 194 in the liner material, or may be a separate member that is brazed or welded in place. Similarly, the inner liner dilution flow extension member aft portion 192 may be formed via an inner liner aft section bend 196 in the liner material, or may be a separate element that is brazed or welded to the outer liner material.

A radial length (i.e., a height) of the inner liner dilution flow extension member 186 may be taken with respect to an inner liner outer surface 200, shown as an imaginary line connecting an inner liner forward section outer surface 202 and an inner liner aft section outer surface 204. The radial length is taken as a distance 198 from the inner liner outer surface 200 to a radially inner surface 206 of the inner liner dilution flow extension member aft portion 192, and from the inner liner outer surface 200 to a radially inner surface 207 of the inner liner dilution flow extension member forward portion 190. As seen in FIG. 6, the radially inner surface 206 of the inner liner dilution flow extension member aft portion 192 may be arranged at a distance 198 from the inner liner outer surface 200 that, as shown in FIG. 6, may be below (i.e., radially outward of) the inner liner outer surface 200. Alternatively, the radially inner surface 206 may be even with the inner liner outer surface 200 such that the distance 198 is zero, or the radially inner surface 206 may extend radially inward of the inner liner outer surface 200, such that the distance 198 extends above the inner liner outer surface 200. The same distance 198 applies to the radially inner surface 207 of the inner liner dilution flow extension member forward portion 190. Additionally, while the radially inner surface 207 of the inner liner dilution flow extension member forward portion 190 and the radially inner surface 206 of the inner liner dilution flow extension member aft portion 192 are shown in FIG. 6 as being arranged at the same distance 198 from the inner liner outer surface 200, they may have different lengths instead. For example, the distance 198 to the radially inner surface 207 of the inner liner dilution flow extension member forward portion 190 may be as shown in FIG. 6 (i.e., above the inner liner outer surface 200), while the distance 198 to the radially inner surface 206 of the inner liner dilution flow extension member aft portion 192 may be such that it is even with the inner liner outer surface 200, or extended radially inward beyond the inner liner outer surface 200. When this arrangement is implemented, the longer length inner liner dilution flow extension member aft portion 192 may provide for deflecting more of the air into the inner liner dilution flow extension member 186.

While the aspect depicted in FIG. 6 generally shows the inner liner dilution flow extension member 186 as being a mirror image of the outer liner dilution flow extension member 164, it is not necessary that they be a mirror image of one another. Rather, as but one example, they may be arranged at different angles. For instance, the outer liner dilution flow extension member 164 may be arranged at minus forty-five degrees as the first angle 166, while the inner liner dilution flow extension member 186 may be arranged at minus thirty degrees as the second angle 188. In addition, the first angle 166 of the outer liner dilution flow extension member 164 may vary circumferentially about the combustor centerline 112. Similarly, the second angle 188 of the inner liner dilution flow extension member 186 may vary circumferentially about the combustor centerline 112. In this case, when the first angle 166 and the second angle 188 vary circumferentially, at any particular cross section as seen FIG. 6, the outer liner dilution flow extension member 164 and the inner liner dilution flow extension member 186 may or may not be a mirror image of one another.

Figure 7:
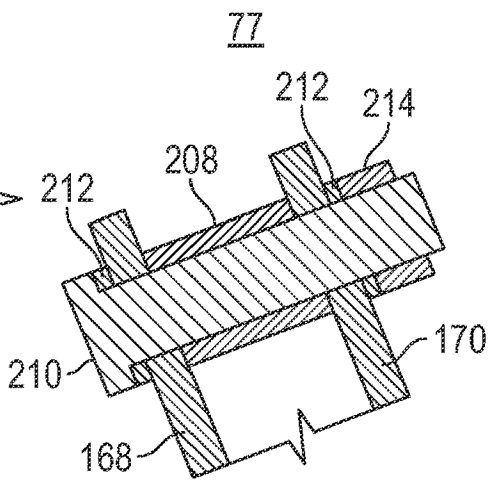
FIG. 7 depicts a partial cross-sectional view of an joint for a combustor liner, according to an aspect of the present disclosure.

FIG. 7 is a detailed view of a liner joint taken at detail view 7-7 in FIG. 6. FIG. 7 depicts one exemplary technique for joining the outer liner forward section 156 and the outer liner aft section 158 at the outer liner dilution flow extension member 164. FIG. 7 depicts a bolted joint in which a spacer 208 is inserted between the outer liner dilution flow extension member forward portion 168 and the outer liner dilution flow extension member aft portion 170. A bolt 210, washers 212, and a nut 214 are inserted through holes in the outer liner dilution flow extension member forward portion 168, the outer liner dilution flow extension member aft portion 170, and the spacer 208. Thus, a bolted joint is formed. A plurality of bolted joints may be intermittently provided circumferentially about the annular outer liner 54. Of course, the present disclosure is not limited to a bolted joint as shown in FIG. 7, and other techniques for joining the outer liner forward section 156 and the outer liner aft section 158 could be implemented instead. For instance, the spacer may be brazed or welded in place instead of being implemented as part of a bolted joint. It is also noted that, while not depicted in FIG. 6 or 7, the same connecting techniques (e.g., the bolted joint) may be implemented with the annular inner liner 52 so as to connect the inner liner forward section 160 with the inner liner aft section 162.

Figure 8:
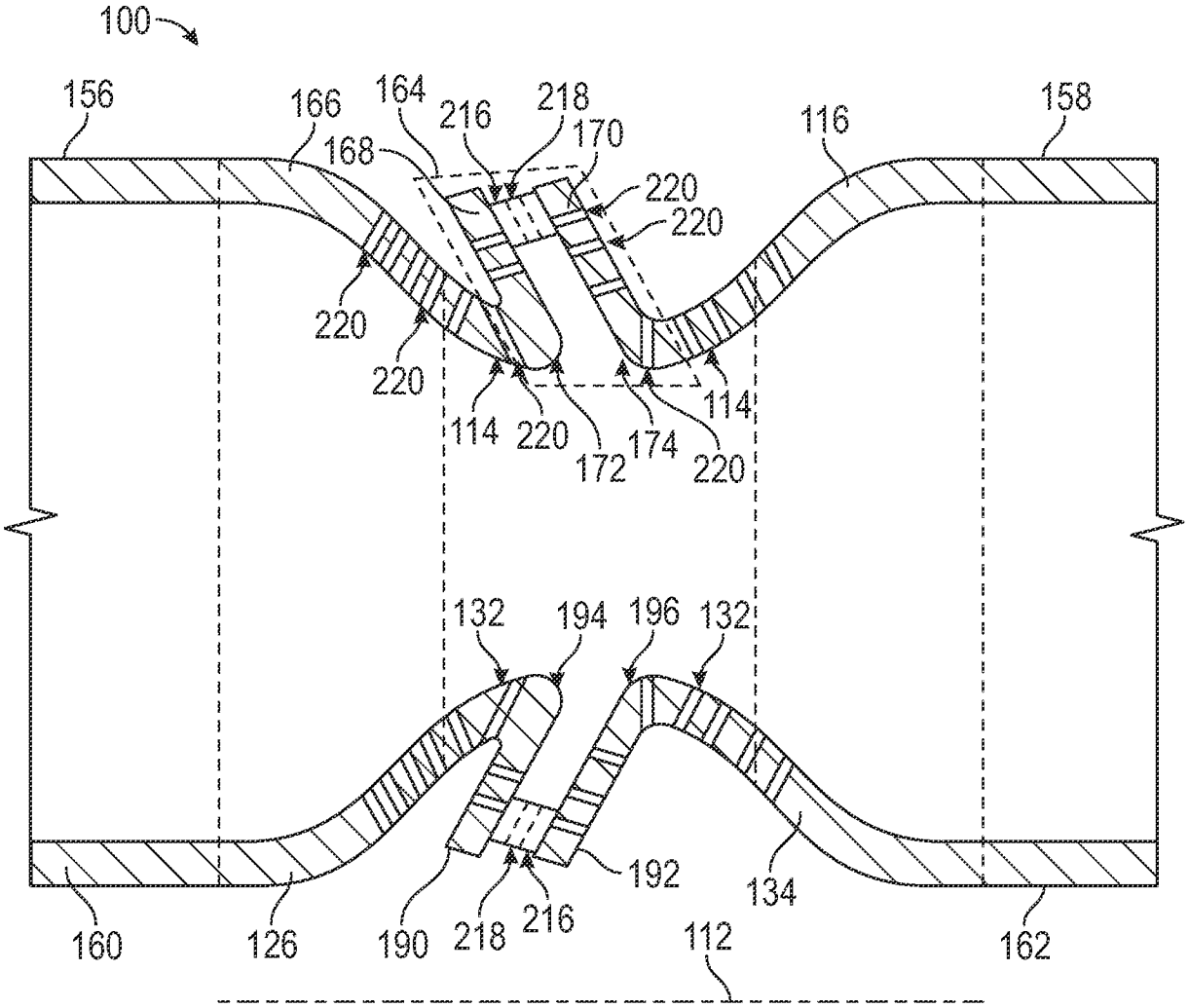
FIG. 8 depicts a partial cross-sectional side view of an exemplary converging-diverging portion of a combustor liner, according to still another aspect of the present disclosure.

FIG. 8 a partial cross-sectional side view of an exemplary combustor liner converging-diverging portion 100, according to still yet another aspect of the present disclosure. The aspect of FIG. 8 is similar to that of FIG. 6, but with some additional features. The common aspects of FIGS. 6 and 8 will not be discussed in more detail below and the description of FIG. 6 above is equally applicable to the common features. In FIG. 8, additional features of perforations in the inner liner and the outer liner, and directional flow inserts are included. The perforations in the liners help to provide surface cooling of the liners, while the directional flow inserts may provide a jet flow of air through the dilution flow extension members in order to provide a deeper penetration of the air flow into the dilution zone of the combustion chamber. More specifically, as seen in FIG. 8, a directional flow insert 216 is provided in both the outer liner dilution flow extension member 164 and the inner liner dilution flow extension member 186. The directional flow insert 216 is seen to include a directional flow insert jet 218, which may be a through-hole in the directional flow insert 216. Alternatively, the directional flow insert jet 218 may be a tapered hole that has a larger opening on one side of the jet (e.g., on the inlet side) and a smaller opening on the other side of the jet (e.g., the outlet side).

The directional flow insert 216 may also be used to form a connection between the outer liner forward section 156 and the outer liner aft section 158 by being brazed or welded to the outer liner dilution flow extension member forward portion 168 and to the outer liner dilution flow extension member aft portion 170. A similar connection is made on the annular inner liner 52 with the directional flow insert 216 being provided between the inner liner dilution flow extension member forward portion 190 and the inner liner dilution flow extension member aft portion 192. The directional flow insert jet 218 is to provide a directional flow of the air through the outer liner dilution flow extension member 164 into the dilution zone 72 of the combustion chamber 62 so as to help provide an even deeper penetration of the air flow into the dilution zone. As with the bolted joint discussed with regard to FIG. 7, a plurality of the directional flow inserts 216 may be circumferentially spaced about annular outer liner 54 and annular inner liner 52 with respect to the combustor centerline 112.

Referring still to FIG. 8, the annular outer liner 54 may further include a plurality perforations 220 through the OLCD section 102, and the annular inner liner 52 may include a plurality of perforations 220 through the ILCD section 104. Referring to the OLCD section 102, the plurality of perforations 220 may be provided through the OLCD section converging portion 106, the OLCD section diverging portion 116, the OLCD section transition portion 114, including either of the outer liner forward section bend 172 or the outer liner aft section bend 174, the outer liner dilution flow extension member forward portion 168 or the outer liner dilution flow extension member aft portion 170. A similar arrangement of plurality of perforations 220 may be provided through the ILCD section converging portion 126, the ILCD section diverging portion 134, the ILCD section transition portion 132, including either of the inner liner forward section bend 194 or the inner liner aft section bend 196, the inner liner dilution flow extension member forward portion 190 or the inner liner dilution flow extension member aft portion 192. The plurality of perforations 220 may be spaced circumferentially about the respective inner liner and the outer liner, or may be included in discreet circumferential sections of the respective liners. The number, size, position, and angular arrangement of the plurality of perforations 220 may be varied to provide a desired cooling effect to the surface of the liners.

Figure 9:
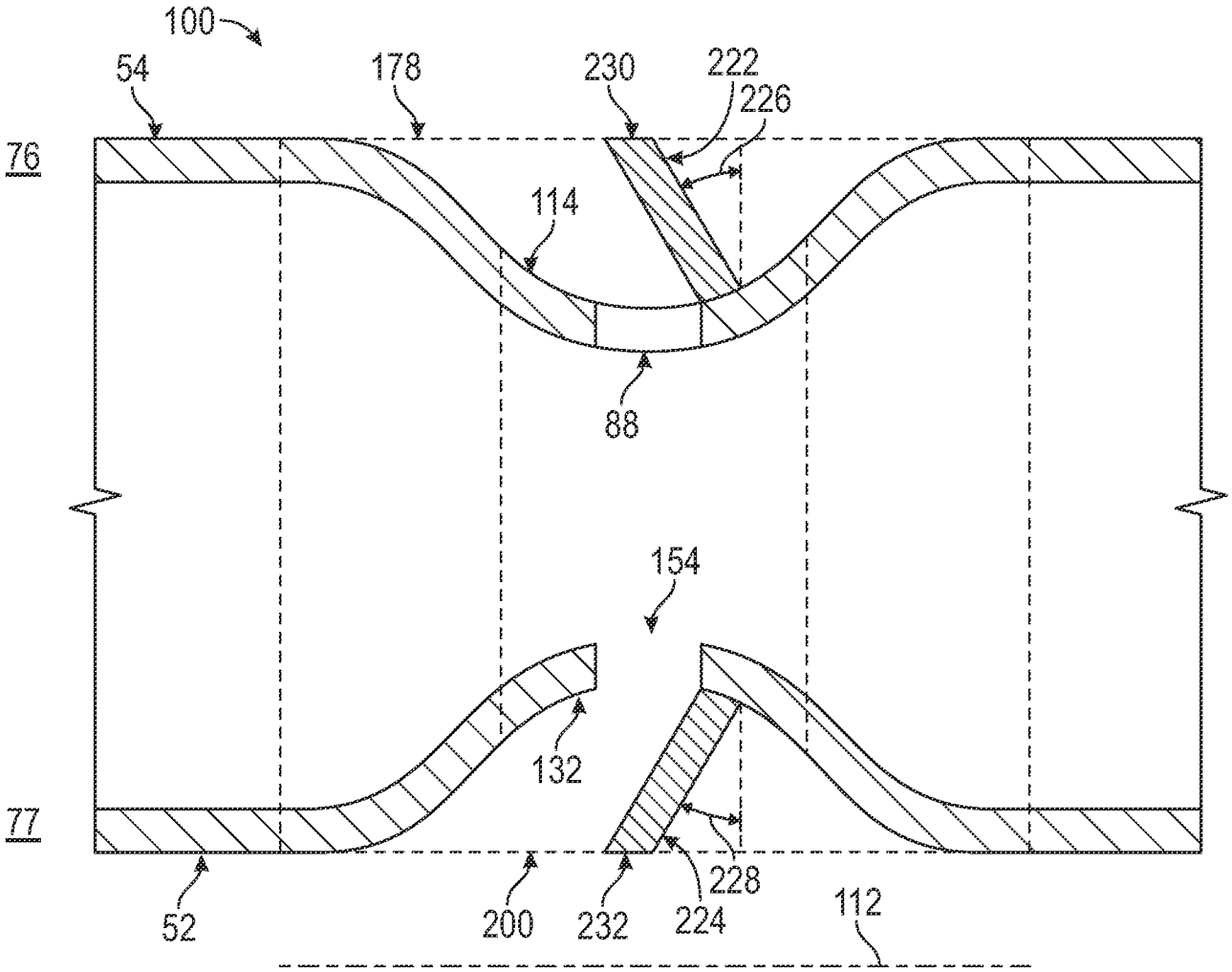
FIG. 9 depicts a partial cross-sectional side view of an exemplary converging-diverging portion of a combustor liner, according to yet another aspect of the present disclosure.

FIG. 9 depicts a partial cross-sectional side view of an exemplary combustor liner converging-diverging portion 100, according to yet another aspect of the present disclosure. The aspect depicted in FIG. 9 is similar to that of FIGS.

3 and 4. In FIG. 9, however, an outer liner dilution opening flow deflector 222 is implemented adjacent to the dilution opening 88, which is depicted as the through hole dilution opening as an example. Similarly, an inner liner dilution opening flow deflector 224 is implemented adjacent to the annular slot dilution opening 154, which is depicted as the annular slot dilution opening as an example. When the dilution opening 88 is implemented as a circular hole, for example, a plurality of the outer liner dilution flow opening deflectors 222 may be included, such that each dilution opening 88 includes a respective outer liner dilution flow deflector 222. When the annular slot dilution opening 154 is implemented in the inner liner 52, the inner liner dilution opening flow deflector 224 may be provided circumferentially about the inner liner adjacent to the annular slot dilution opening 154. Of course, the present disclosure is not limited to an implementation of the dilution opening 88 with the outer liner dilution opening flow deflector 222 in the OLCD section 102, and the annular slot dilution opening 152 may be implemented in the OLCD section 102 (FIGS. 3 and 4) with the outer liner dilution flow deflector 222 instead. Similarly, the dilution opening 90 (FIG. 3) with the inner liner dilution flow deflector 224 may be implemented in the ILCD section 104 instead. Alternatively, any combination of the foregoing may be implemented between the OLCD section 102 and the ILCD section 104.

An outer liner deflector angle 226 of the outer liner dilution opening flow deflector 222, and an inner liner deflector angle 228 of the inner liner dilution opening flow deflector 224 may be set to obtain a desired amount of flow of air into the dilution zone 72 of the combustion chamber 62, and/or a desired directional flow of the air into the dilution zone 72 of the combustion chamber 62 (FIG. 2). As an example, the outer liner deflector angle may range from zero degrees (i.e., perpendicular to the combustor centerline 112, to minus forty-five degrees (i.e., towards the upstream end 76 of the annular outer liner 54). Similarly, the inner liner deflector angle 228 may range from zero degrees (i.e., perpendicular to the combustor centerline 112) to plus forty-five degrees (i.e., toward the upstream end 77 of the annular inner liner 52). Of course, other angles could be implemented instead. Further, the height of each of the deflectors may be varied to obtain the desired amount of air flow through the dilution openings. For example, as seen in FIG. 9, the height of the outer liner dilution opening flow deflector 222 may be such that an outer liner deflector outer end 230 is arranged to be even with the outer liner outer surface 178 of the annular outer liner 54. Of course, the height of the outer liner dilution opening flow deflector 222 may instead be such that the outer liner deflector outer end 230 extends radially outward beyond the outer liner outer surface 178, or may be such that the outer liner deflector outer end 230 is radially inward of the outer liner outer surface 178. The height of the inner liner dilution opening flow deflector 224 may be similar, such that an inner liner deflector outer end 232 is even with the inner liner outer surface 200, extends radially inward of the inner liner outer surface 200, or is radially outward of the inner liner outer surface 200.

Figure 10:
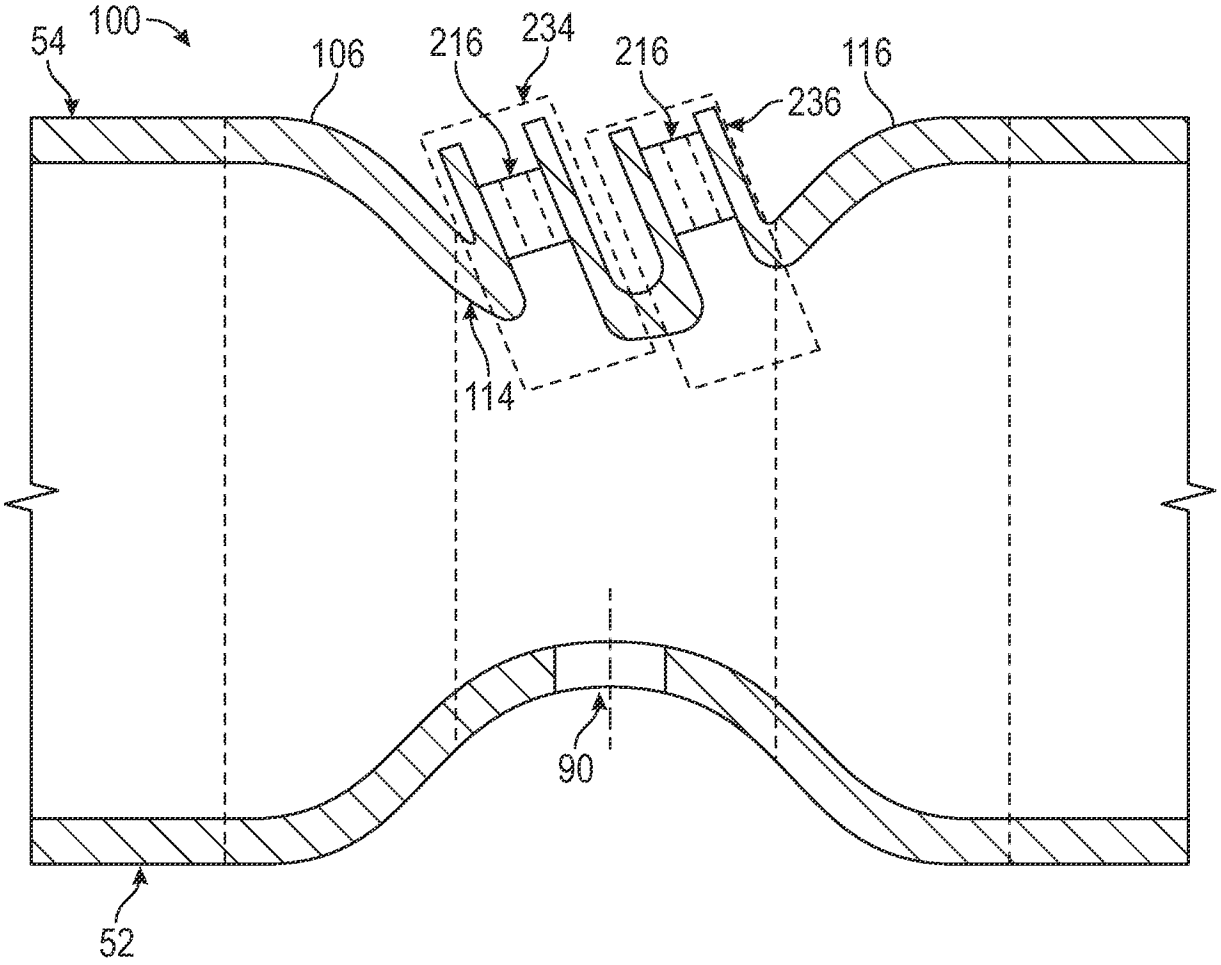
FIG. 10 depicts a partial cross-sectional side view of an exemplary converging-diverging portion of a combustor liner, according to still another aspect of the present disclosure.

FIG. 10 depicts a partial cross-sectional side view of an exemplary converging-diverging portion of a combustor liner, according to still another aspect of the present disclosure. In FIG. 10, an arrangement is depicted where multiple dilution flow extension members are provided. In the example of FIG. 10, a first dilution flow extension member 234 and a second dilution flow extension member 236 are provided in the OLCD section transition portion 114. Each of the first dilution flow extension member 234 and the second dilution flow extension member 236 may be similar to the outer liner dilution flow extension member 164 as depicted in FIG. 8 and may include the directional flow insert 216. While FIG. 10 depicts the dilution opening 90 through the annular inner liner 52, the annular inner liner 52 may also include the multiple dilution flow extension members similar to the annular outer liner 54.

Figure 11:
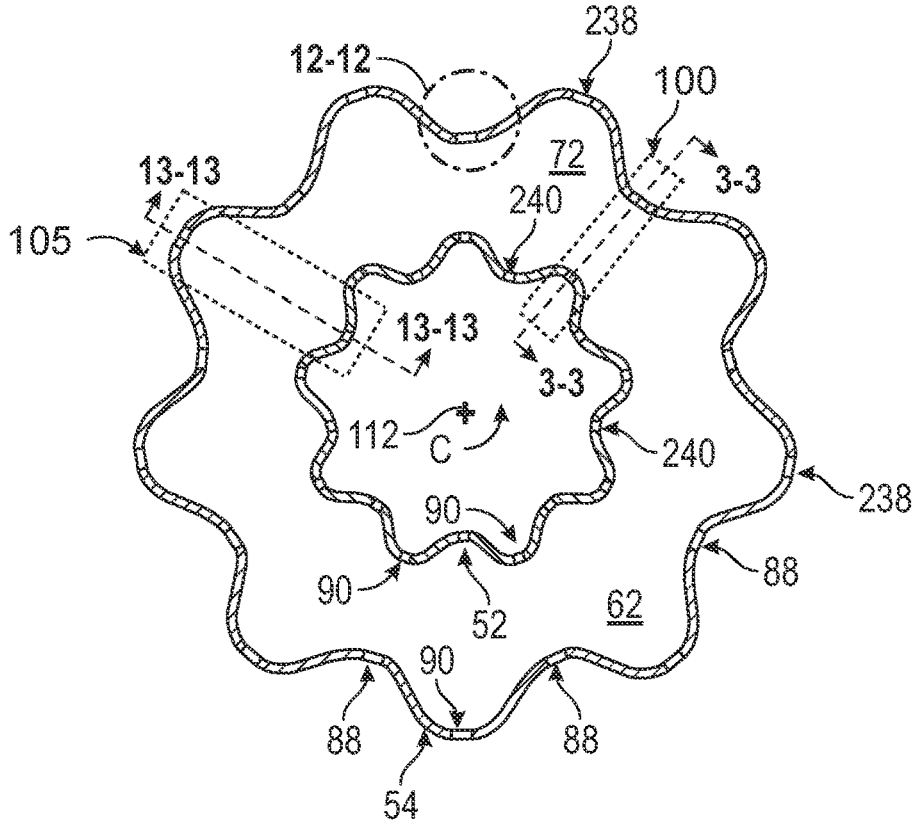
FIG. 11 is a partial cross-section forward looking view of an exemplary converging-diverging combustor liner, taken at plane 11-11 in FIG. 2, according to an aspect of the present disclosure.
Figure 13:
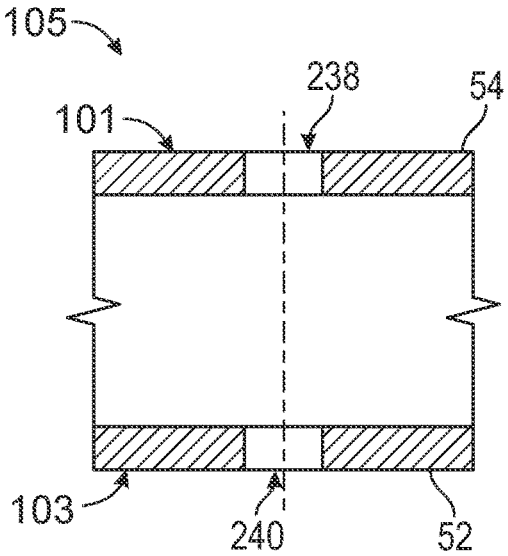
FIG. 13 is a partial cross-sectional side view of a combustor taken at plane 13-13 of FIG. 11, according to an aspect of the present disclosure.

FIG. 11 is a partial cross-section forward looking view of an exemplary converging-diverging combustor liner, taken at plane 11-11 in FIG. 2, according to an aspect of the present disclosure. The aspect depicted in FIG. 11 is a cross section through the entire circumference of the combustor liner about combustor centerline 112 taken at plane 11-11 shown in FIG. 3. In FIG. 11, the annular inner liner 52 and the annular outer liner 54 are seen to include converging-diverging portions 100, such as those shown in FIG. 3 and taken at plane 3-3 in FIG. 11, circumferentially about the combustor centerline 112, and circumferentially alternating non-converging-diverging portions 105, such as that shown in FIG. 13 and taken at plane 13-13 in FIG. 11. For example, circumferentially, a converging-diverging portion 100 may be included such as that shown at plane 3-3, representing the converging-diverging portion 100, and alternately, in the circumferential direction C, a non-converging-diverging portion 105, such as that shown in FIG. 13, may be located on either side of the converging-diverging portion 100. Here, in the non-converging-diverging portion 105, an outer liner non-converging-diverging portion 101 may include a plurality of dilution holes 238 in the annular outer liner 54 and an inner liner non-converging-diverging portion 103 may include a plurality of dilution holes 240 in the annular inner liner 52.

Figure 12:
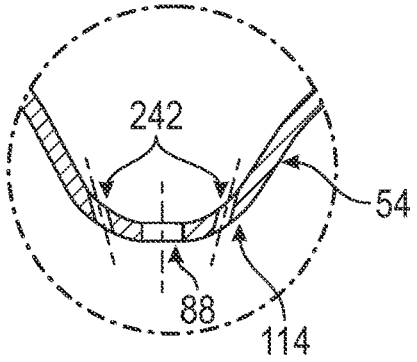
FIG. 12 is an enlarged detailed view of a portion of a combustor liner taken at detail 12-12 in FIG. 11.

FIG. 12 is an enlarged detail view taken at detail 12-12 of FIG. 11. In FIG. 12, the annular outer liner 54 is seen to include the dilution opening 88 through the OLCD section transition portion 114, as seen in FIG. 3. Circumferentially, a plurality of dilution jets 242 may be included through the annular outer liner 54 adjacent to the dilution opening 88. The dilution jets 242 may be angled inward to provide a jet flow of air toward the airflow through the dilution opening 88.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A combustor liner for a combustor of a gas turbine, the combustor liner comprising: an annular outer liner extending circumferentially about a combustor centerline of the combustor, and extending in a longitudinal direction, with respect to the combustor centerline, from an outer liner upstream end of the annular outer liner to an outer liner downstream end of the annular outer liner; and an annular inner liner extending circumferentially about the combustor centerline, and extending in the longitudinal direction, with respect to the combustor centerline, from an inner liner upstream end of the annular inner liner to an inner liner downstream end of the annular inner liner, the annular outer liner and the annular inner liner defining a combustion chamber therebetween, the combustion chamber having a primary combustion zone defined at an upstream end of the combustion chamber, a secondary combustion zone defined at a downstream end of the combustion chamber, and a dilution zone defined between the primary combustion zone and the secondary combustion zone, wherein the annular outer liner comprises an outer liner converging-diverging (OLCD) section extending radially inward in the longitudinal direction, with respect to the combustor centerline, into the dilution zone of the combustion chamber, and the annular inner liner comprises an inner liner converging-diverging (ILCD) section extending radially outward in the longitudinal direction, with respect to the combustor centerline, into the dilution zone of the combustion chamber, the OLCD section and the ILCD section being radially opposed to one another across the combustion chamber, and wherein the OLCD section comprises at least one outer liner dilution opening defined through the OLCD section for providing a flow of an oxidizer through the outer liner to the dilution zone of the combustion chamber, and the ILCD section comprises at least one inner liner dilution opening defined through the ILCD section for providing a flow of the oxidizer through the inner liner to the dilution zone of the combustion chamber.

The combustor liner according to any preceding clause, wherein, circumferentially about the combustor centerline, the OLCD section further extends radially inward in the circumferential direction, with respect to the combustor centerline, into the dilution zone of the combustion chamber, and the ILCD section further extends radially outward in the circumferential direction, with respect to the combustor centerline, into the dilution zone of the combustion chamber, the OLCD section and the ILCD section being radially opposed to one another across the combustion chamber, and wherein the combustor liner further comprises a plurality of outer liner non-converging-diverging sections, alternately spaced circumferentially about the combustor centerline, between respective ones of a plurality of the OLCD sections, and a plurality of inner liner non-converging-diverging sections, alternately spaced circumferentially about the combustor centerline, between respective ones of a plurality of the ILCD sections.

The combustor according to any preceding clause, wherein the outer liner further comprises at least one outer liner dilution opening flow deflector adjacent to respective ones of the at least one outer liner dilution opening, and wherein the inner liner further comprises at least one inner liner dilution opening flow deflector adjacent to respective ones of the at least one inner liner dilution opening.

The combustor liner according to any preceding clause, wherein, the OLCD section comprises: (i) an OLCD section converging portion converging radially inward and longitudinally aft, with respect to the combustor centerline, into the combustion chamber from an upstream end of the OLCD section to an upstream end of an OLCD section transition portion, (ii) an OLCD section diverging portion extending radially outward and longitudinally aft, with respect to the combustor centerline, from a downstream end of the OLCD section transition portion to a downstream end of the OLCD section, and (iii) the OLCD section transition portion connecting a downstream end of the OLCD section converging portion and an upstream end of the OLCD section diverging portion, and the ILCD section comprises: (i) an ILCD section converging portion converging radially outward and longitudinally aft, with respect to the combustor centerline, into the combustion chamber from an upstream end of the ILCD section to an upstream end of an ILCD section transition portion, (ii) an ILCD section diverging portion extending radially inward and longitudinally aft, with respect to the combustor centerline, from a downstream end of the ILCD section transition portion to a downstream end of the ILCD section, and (iii) the ILCD section transition portion connecting a downstream end of the ILCD converging portion and an upstream end of the ILCD section diverging portion.

The combustor liner according to any preceding clause, wherein the OLCD section transition portion has a parabolic shape with a focus thereof being located on a radially outward side of the OLCD section transition portion, with respect to the combustor centerline, and the ILCD section transition portion has a parabolic shape with a focus thereof being located on a radially inward side of the ILCD section transition portion, with respect to the combustor centerline.

The combustor liner according to any preceding clause, wherein the at least one outer liner dilution opening is defined through the OLCD section transition portion, and the at least one inner liner dilution opening is defined through the ILCD section transition portion.

The combustor liner according to any preceding clause, wherein the at least one outer liner dilution opening comprises a plurality of outer liner dilution holes, and the at least one inner liner dilution opening comprises a plurality of inner liner dilution holes.

The combustor liner according to any preceding clause, wherein respective ones of the outer liner dilution holes among the plurality of outer liner dilution holes is directly opposed across the combustion chamber by respective ones of the inner liner dilution holes among the plurality of inner liner dilution holes.

The combustor liner according to any preceding clause, wherein respective ones of the plurality of outer liner dilution holes are arranged at a radial angle in a range from minus thirty degrees to plus thirty degrees with respect to the combustor centerline, and wherein respective ones of the plurality of inner liner dilution holes are arranged at a radial angle in a range from minus thirty degrees to plus thirty degrees with respect to the combustor centerline.

The combustor liner according to any preceding clause, wherein the at least one outer liner dilution opening and the at least one inner liner dilution opening each comprises an annular slot.

The combustor liner according to any preceding clause, wherein an outer liner forward section is defined forward of the annular slot through the outer liner, and an outer liner aft section is defined aft of the annular slot through the outer liner, a plurality of outer liner connecting members connecting the outer liner forward section and the outer liner aft section, and wherein an inner liner forward section is defined forward of the annular slot through the inner liner, and an inner liner aft section is defined aft of the annular slot through the inner liner, a plurality of inner liner connecting members connecting the inner liner forward section and the inner liner aft section.

The combustor liner according to any preceding clause, wherein the at least one outer liner dilution opening further comprises a plurality of outer liner dilution holes, and wherein the at least one inner liner dilution opening further comprises a plurality of inner liner dilution holes.

The combustor liner according to any preceding clause, wherein the annular slot through the outer liner is opposed across the combustion chamber by the plurality of inner liner dilution holes, and the annular slot through the inner liner is opposed across the combustion chamber by the plurality of outer liner dilution holes.

The combustor liner according to any preceding clause, wherein the annular slot of the annular outer liner includes an outer liner dilution flow extension member extending radially outward with respect to the combustor centerline from the annular outer liner, and the annular slot of the annular inner liner includes an inner liner dilution flow extension member extending radially inward with respect to the combustor centerline from the annular inner liner.

The combustor liner according to any preceding clause, wherein the outer liner dilution flow extension member further extends upstream at a first angle relative to the combustor centerline, and the inner liner dilution flow extension member further extends upstream at a second angle relative to the combustor centerline.

The combustor liner according to any preceding clause, wherein the outer liner forward section includes an outer liner dilution flow extension member forward portion of the outer liner dilution flow extension member, and the outer liner aft section includes an outer liner dilution flow extension member aft portion of the outer liner dilution flow extension member, and wherein the inner liner forward section includes an inner liner dilution flow extension member forward portion of the inner liner dilution flow extension member, and the inner liner aft section includes an inner liner dilution flow extension member aft portion of the inner liner dilution flow extension member.

The combustor liner according to any preceding clause, wherein the annular outer liner further comprises a plurality of outer liner perforations through the OLCD section converging portion, through the OLCD section diverging portion, and/or through the OLCD section transition portion, and wherein the annular inner liner further comprises a plurality of inner liner perforations through the ILCD section converging portion, through the ILCD section diverging portion, and/or through the ILCD section transition portion.

The combustor liner according to any preceding clause, wherein the outer liner dilution flow extension member includes a plurality of outer liner directional flow inserts circumferentially spaced about the combustor centerline, and the inner liner dilution flow extension member includes a plurality of inner liner directional flow inserts circumferentially spaced about the combustor centerline.

The combustor liner according to any preceding clause, wherein at least one of the outer liner forward section, the outer liner aft section, the inner liner forward section and/or the inner liner aft section includes a plurality of dilution flow extension members each having a directional flow insert.

The combustor liner according to any preceding clause, where the at least one outer liner dilution opening is defined through one or more of the OLCD section converging portion, the OLCD section diverging portion, and the OLCD section transition portion, and wherein the at least one inner liner dilution opening is defined through one or more of the ILCD section converging portion, the ILCD section diverging portion, and the ILCD section transition portion.

A combustor for a gas turbine, the combustor comprising: a combustor liner; a dome assembly connected to an upstream end of the combustor liner; a swirler assembly connected to the dome assembly; and a fuel nozzle assembly connected to the swirler assembly, wherein the combustor liner comprises: (a) an annular outer liner extending circumferentially about a combustor centerline of the combustor, and extending in a longitudinal direction, with respect to the combustor centerline, from an outer liner upstream end of the annular outer liner to an outer liner downstream end of the annular outer liner; and (b) an annular inner liner extending circumferentially about the combustor centerline, and extending in the longitudinal direction, with respect to the combustor centerline, from an inner liner upstream end of the annular inner liner to an inner liner downstream end of the annular inner liner, the annular outer liner and the annular inner liner defining a combustion chamber therebetween, the combustion chamber having a primary combustion zone defined at an upstream end of the combustion chamber, a secondary combustion zone defined at a downstream end of the combustion chamber, and a dilution zone defined between the primary combustion zone and the secondary combustion zone, wherein the annular outer liner comprises an outer liner converging-diverging (OLCD) section extending radially inward in the longitudinal direction, with respect to the combustor centerline, into the dilution zone of the combustion chamber, and the annular inner liner comprises an inner liner converging-diverging (ILCD) section extending radially outward in the longitudinal direction, with respect to the combustor centerline, into the dilution zone of the combustion chamber, the OLCD section and the ILCD section being radially opposed to one another across the combustion chamber, and wherein, the OLCD section comprises at least one outer liner dilution opening defined through the OLCD section for providing a flow of an oxidizer through the outer liner to the dilution zone of the combustion chamber, and the ILCD section comprises at least one inner liner dilution opening defined through the ILCD section for providing a flow of the oxidizer through the inner liner to the dilution zone of the combustion chamber.

The combustor according to any preceding clause, wherein the OLCD section comprises: (i) an OLCD section converging portion converging radially inward and longitudinally aft, with respect to the combustor centerline, into the combustion chamber from an upstream end of the OLCD section to an upstream end of an OLCD section transition portion, (ii) an OLCD section diverging portion extending radially outward and longitudinally aft, with respect to the combustor centerline, from a downstream end of the OLCD section transition portion to a downstream end of the OLCD section, and (iii) the OLCD section transition portion connecting a downstream end of the OLCD section converging portion and an upstream end of the OLCD section diverging portion, and the ILCD section comprises: (i) an ILCD section converging portion converging radially outward and longitudinally aft, with respect to the combustor centerline, into the combustion chamber from an upstream end of the ILCD section to an upstream end of an ILCD section transition portion, (ii) an ILCD section diverging portion extending radially inward and longitudinally aft, with respect to the combustor centerline, from a downstream end of the ILCD section transition portion to a downstream end of the ILCD section, and (iii) the ILCD section transition portion connecting a downstream end of the ILCD converging portion and an upstream end of the ILCD section diverging portion.

The combustor according to any preceding clause, wherein the at least one outer liner dilution opening is defined through the OLCD section transition portion, and the at least one inner liner dilution opening is defined through the ILCD section transition portion.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor liner for a combustor of a gas turbine, the combustor liner comprising:

an annular outer liner extending circumferentially about a combustor centerline of the combustor, and extending in a longitudinal direction, with respect to the combustor centerline, from an outer liner upstream end of the annular outer liner to an outer liner downstream end of the annular outer liner; and an annular inner liner extending circumferentially about the combustor centerline, and extending in the longitudinal direction, with respect to the combustor centerline, from an inner liner upstream end of the annular inner liner to an inner liner downstream end of the annular inner liner, the annular outer liner and the annular inner liner defining a combustion chamber therebetween, the combustion chamber having a primary combustion zone defined at an upstream end of the combustion chamber, a secondary combustion zone defined at a downstream end of the combustion chamber, and a dilution zone defined between the primary combustion zone and the secondary combustion zone, wherein the annular outer liner comprises an outer liner converging-diverging (OLCD) section extending radially inward in the longitudinal direction, with respect to the combustor centerline, into the dilution zone of the combustion chamber, and the annular inner liner comprises an inner liner converging-diverging (ILCD) section extending radially outward in the longitudinal direction, with respect to the combustor centerline, into the dilution zone of the combustion chamber, the OLCD section and the ILCD section being radially opposed to one another across the combustion chamber, and wherein the OLCD section comprises at least one outer liner dilution opening defined through the OLCD section for providing a flow of an oxidizer through the annular outer liner to the dilution zone of the combustion chamber, and the ILCD section comprises at least one inner liner dilution opening defined through the ILCD section for providing a flow of the oxidizer through the annular inner liner to the dilution zone of the combustion chamber, the at least one outer liner dilution opening comprising an outer liner annular slot and a plurality of outer liner dilution holes longitudinally offset from the outer liner annular slot, and the at least one inner liner dilution opening comprising an inner liner annular slot and a plurality of inner line dilution holes longitudinally offset from the inner liner annular slot, the outer liner annular slot being opposed across the combustion chamber by the plurality of inner liner dilution holes, and the inner liner annular slot being opposed across the combustion chamber by the plurality of outer liner dilution holes.

2. The combustor liner according to claim 1, wherein, circumferentially about the combustor centerline, the OLCD section further extends radially inward in the circumferential direction, with respect to the combustor centerline, into the dilution zone of the combustion chamber, and the ILCD section further extends radially outward in the circumferential direction, with respect to the combustor centerline, into the dilution zone of the combustion chamber, the OLCD section and the ILCD section being radially opposed to one another across the combustion chamber, and wherein the combustor liner further comprises a plurality of outer liner non-converging-diverging sections, alternately spaced circumferentially about the combustor centerline, between respective ones of a plurality of the OLCD sections, and a plurality of inner liner non-converging-diverging sections, alternately spaced circumferentially about the combustor centerline, between respective ones of a plurality of the ILCD sections.

3. The combustor according to claim 1, wherein the annular outer liner further comprises at least one outer liner dilution opening flow deflector adjacent to respective ones of the at least one outer liner dilution opening, and wherein the annular inner liner further comprises at least one inner liner dilution opening flow deflector adjacent to respective ones of the at least one inner liner dilution opening.

4. The combustor liner according to claim 1, wherein, the OLCD section comprises:

(i) an OLCD section converging portion converging radially inward and longitudinally aft, with respect to the combustor centerline, into the combustion chamber from an upstream end of the OLCD section to an upstream end of an OLCD section transition portion, (ii) an OLCD section diverging portion extending radially outward and longitudinally aft, with respect to the combustor centerline, from a downstream end of the OLCD section transition portion to a downstream end of the OLCD section, and (iii) the OLCD section transition portion connecting a downstream end of the OLCD section converging portion and an upstream end of the OLCD section diverging portion, and the ILCD section comprises:

(i) an ILCD section converging portion converging radially outward and longitudinally aft, with respect to the combustor centerline, into the combustion chamber from an upstream end of the ILCD section to an upstream end of an ILCD section transition portion, (ii) an ILCD section diverging portion extending radially inward and longitudinally aft, with respect to the combustor centerline, from a downstream end of the ILCD section transition portion to a downstream end of the ILCD section, and (iii) the ILCD section transition portion connecting a downstream end of the ILCD converging portion and an upstream end of the ILCD section diverging portion.

5. The combustor liner according to claim 4, wherein the OLCD section transition portion has a parabolic shape with a focus thereof being located on a radially outward side of the OLCD section transition portion, with respect to the combustor centerline, and the ILCD section transition portion has a parabolic shape with a focus thereof being located on a radially inward side of the ILCD section transition portion, with respect to the combustor centerline.

6. The combustor liner according to claim 4, wherein the at least one outer liner dilution opening is defined through the OLCD section transition portion, and the at least one inner liner dilution opening is defined through the ILCD section transition portion.

7. The combustor liner according to claim 1, wherein respective ones of the plurality of outer liner dilution holes are arranged at a radial angle in a range from minus thirty degrees to plus thirty degrees with respect to the combustor centerline, and wherein respective ones of the plurality of inner liner dilution holes are arranged at a radial angle in a range from minus thirty degrees to plus thirty degrees with respect to the combustor centerline.

8. The combustor liner according to claim 1, wherein an outer liner forward section is defined forward of the outer liner annular slot, and an outer liner aft section is defined aft of the outer liner annular slot, a plurality of outer liner connecting members connecting the outer liner forward section and the outer liner aft section, and wherein an inner liner forward section is defined forward of the inner liner annular slot, and an inner liner aft section is defined aft of the inner liner annular, a plurality of inner liner connecting members connecting the inner liner forward section and the inner liner aft section.

9. The combustor liner according to claim 8, wherein at least one of the outer liner annular slot includes an outer liner dilution flow extension member extending radially outward with respect to the combustor centerline from the annular outer liner, or the inner liner annular slot includes an inner liner dilution flow extension member extending radially inward with respect to the combustor centerline from the annular inner liner.

10. The combustor liner according to claim 9, wherein the outer liner dilution flow extension member further extends upstream at a first angle relative to the combustor centerline, and the inner liner dilution flow extension member further extends upstream at a second angle relative to the combustor centerline.

11. The combustor liner according to claim 10, wherein the outer liner forward section includes an outer liner dilution flow extension member forward portion of the outer liner dilution flow extension member, and the outer liner aft section includes an outer liner dilution flow extension member aft portion of the outer liner dilution flow extension member, and wherein the inner liner forward section includes an inner liner dilution flow extension member forward portion of the inner liner dilution flow extension member, and the inner liner aft section includes an inner liner dilution flow extension member aft portion of the inner liner dilution flow extension member.

12. The combustor liner according to claim 9, wherein the annular outer liner further comprises a plurality of outer liner perforations through the OLCD section converging portion, through the OLCD section diverging portion, and/or through the OLCD section transition portion, and wherein the annular inner liner further comprises a plurality of inner liner perforations through the ILCD section converging portion, through the ILCD section diverging portion, and/or through the ILCD section transition portion.

13. The combustor liner according to claim 9, wherein the outer liner dilution flow extension member includes a plurality of outer liner directional flow inserts circumferentially spaced about the combustor centerline, and the inner liner dilution flow extension member includes a plurality of inner liner directional flow inserts circumferentially spaced about the combustor centerline.

14. The combustor liner according to claim 9, wherein at least one of the outer liner forward section, the outer liner aft section, the inner liner forward section or the inner liner aft section includes a plurality of dilution flow extension members each having a directional flow insert.

15. The combustor liner according to claim 4, where the at least one outer liner dilution opening is defined through one or more of the OLCD section converging portion, the OLCD section diverging portion, and the OLCD section transition portion, and wherein the at least one inner liner dilution opening is defined through one or more of the ILCD section converging portion, the ILCD section diverging portion, and the ILCD section transition portion.

16. A combustor liner for a combustor of a gas turbine, the combustor liner comprising:

an annular outer liner extending circumferentially about a combustor centerline of the combustor, and extending in a longitudinal direction, with respect to the combustor centerline, from an outer liner upstream end of the annular outer liner to an outer liner downstream end of the annular outer liner; and an annular inner liner extending circumferentially about the combustor centerline, and extending in the longitudinal direction, with respect to the combustor centerline, from an inner liner upstream end of the annular inner liner to an inner liner downstream end of the annular inner liner, the annular outer liner and the annular inner liner defining a combustion chamber therebetween, the combustion chamber having a primary combustion zone defined at an upstream end of the combustion chamber, a secondary combustion zone defined at a downstream end of the combustion chamber, and a dilution zone defined between the primary combustion zone and the secondary combustion zone, wherein the annular outer liner comprises an outer liner converging-diverging (OLCD) section extending radially inward in the longitudinal direction, with respect to the combustor centerline, into the dilution zone of the combustion chamber, and the annular inner liner comprises an inner liner converging-diverging (ILCD) section extending radially outward in the longitudinal direction, with respect to the combustor centerline, into the dilution zone of the combustion chamber, the OLCD section and the ILCD section being radially opposed to one another across the combustion chamber, and wherein the OLCD section comprises at least one outer liner dilution opening defined through the OLCD section for providing a flow of an oxidizer through the annular outer liner to the dilution zone of the combustion chamber, and the ILCD section comprises at least one inner liner dilution opening defined through the ILCD section for providing a flow of the oxidizer through the annular inner liner to the dilution zone of the combustion chamber, wherein the at least one outer liner dilution opening comprises an outer liner annular slot, and the at least one inner liner dilution opening comprises an inner liner annular slot, wherein an outer liner forward section is defined forward of the outer liner annular slot through the annular outer liner, and an outer liner aft section is defined aft of the outer liner annular slot through the annular outer liner, a plurality of outer liner connecting members connecting the outer liner forward section and the outer liner aft section, and an inner liner forward section is defined forward of the inner liner annular slot through the annular inner liner, and an inner liner aft section is defined aft of the inner liner annular slot through the annular inner liner, a plurality of inner liner connecting members connecting the inner liner forward section and the inner liner aft section, and wherein at least one of the outer liner annular slot includes an outer liner dilution flow extension member extending radially outward with respect to the combustor centerline from the annular outer liner, or the inner liner annular slot includes an inner liner dilution flow extension member extending radially inward with respect to the combustor centerline from the annular inner liner.

17. The combustor liner according to claim 16, wherein the outer liner dilution flow extension member further extends upstream at a first angle relative to the combustor centerline, and the inner liner dilution flow extension member further extends upstream at a second angle relative to the combustor centerline.

18. The combustor liner according to claim 17, wherein the outer liner forward section includes an outer liner dilution flow extension member forward portion of the outer liner dilution flow extension member, and the outer liner aft section includes an outer liner dilution flow extension member aft portion of the outer liner dilution flow extension member, and wherein the inner liner forward section includes an inner liner dilution flow extension member forward portion of the inner liner dilution flow extension member, and the inner liner aft section includes an inner liner dilution flow extension member aft portion of the inner liner dilution flow extension member.

19. The combustor liner according to claim 16, wherein the annular outer liner further comprises a plurality of outer liner perforations through the OLCD section converging portion, through the OLCD section diverging portion, and/or through the OLCD section transition portion, and wherein the annular inner liner further comprises a plurality of inner liner perforations through the ILCD section converging portion, through the ILCD section diverging portion, and/or through the ILCD section transition portion.

20. The combustor liner according to claim 16, wherein the outer liner dilution flow extension member includes a plurality of outer liner directional flow inserts circumferentially spaced about the combustor centerline, and the inner liner dilution flow extension member includes a plurality of inner liner directional flow inserts circumferentially spaced about the combustor centerline.

* * * * *